United States Patent [19]

Cullen et al.

[11] Patent Number: 4,813,791

[45] Date of Patent: Mar. 21, 1989

[54] BAG WITH INTEGRAL MATERIAL TREATING PACKETS

[75] Inventors: John S. Cullen, Buffalo; Samuel A. Incorvia, Tonawanda, both of N.Y.

[73] Assignee: Multiform Desiccants, Inc., Buffalo, N.Y.

[21] Appl. No.: 98,156

[22] Filed: Sep. 18, 1987

[51] Int. Cl.[4] ..... B65D 30/22

[52] U.S. Cl. ..... 383/40

[58] Field of Search ..... 383/40, 127; 206/204, 206/205; 220/403, 404

[56] References Cited

U.S. PATENT DOCUMENTS

| | | | |
|---|---|---|---|
| 1,836,297 | 12/1931 | Vienna | 383/40 X |
| 2,524,162 | 10/1950 | Chavannes et al. | 206/204 X |
| 3,084,984 | 4/1963 | Adler | 206/204 X |
| 3,939,971 | 2/1976 | Tulis | 206/205 |
| 4,275,835 | 6/1981 | Miksic et al. | 206/205 X |
| 4,321,997 | 3/1982 | Miller | 206/205 X |
| 4,463,847 | 8/1984 | Gordon | 206/205 |
| 4,619,361 | 10/1986 | Thomas, Jr. | 206/204 |

*Primary Examiner*—Stephen Marcus
*Assistant Examiner*—Nova Stucker
*Attorney, Agent, or Firm*—Joseph P. Gastel

[57] ABSTRACT

A bag for containing bulk material which may be inserted as a liner in a drum type of container, the bag containing a plurality of packets of conditioning material firmly secured to the inside surface thereof for maintaining bulk material within the bag in a desired state of preservation, the conditioning material within the packets being either a suitable desiccant, adsorbent or absorbent, and the packets including permeable casings which permit the conditioning material therein to act on the space within the bag and on the bulk material contained therein.

16 Claims, 1 Drawing Sheet

Fig. 1.
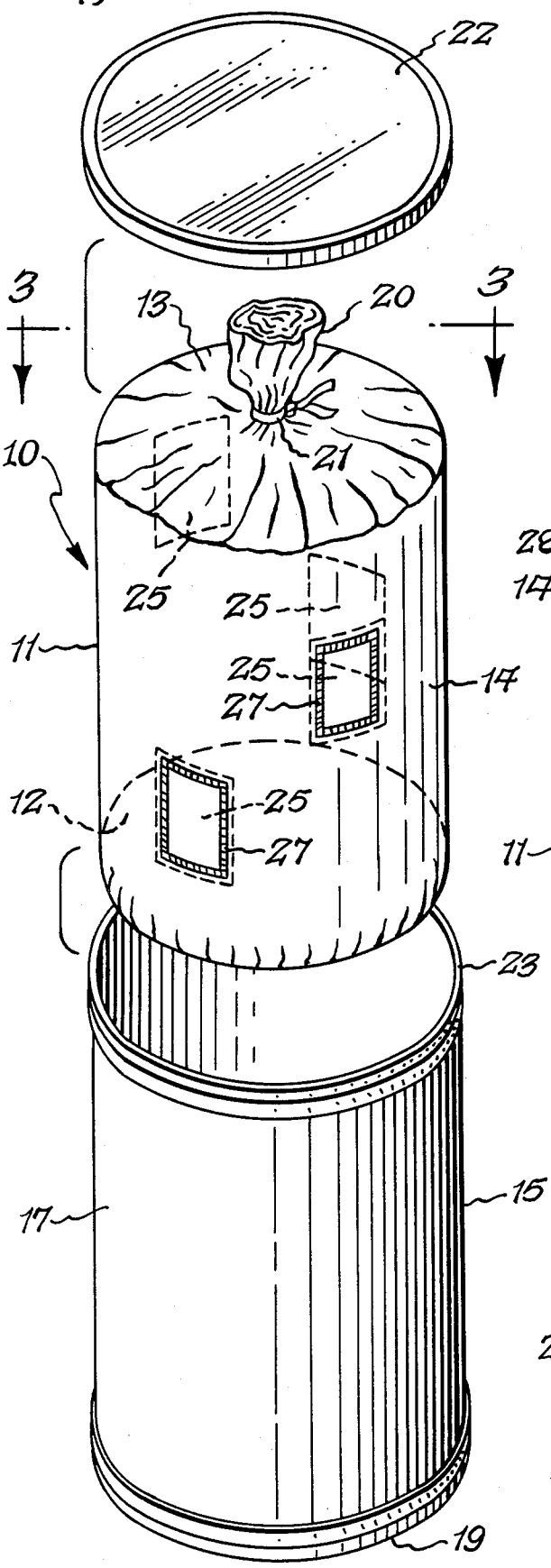
Fig. 3.
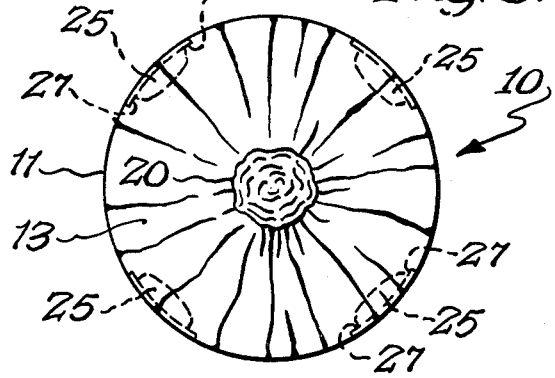
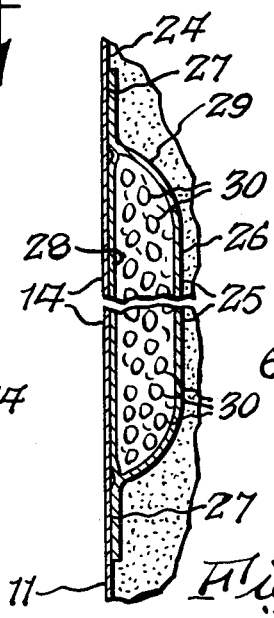
Fig. 5.
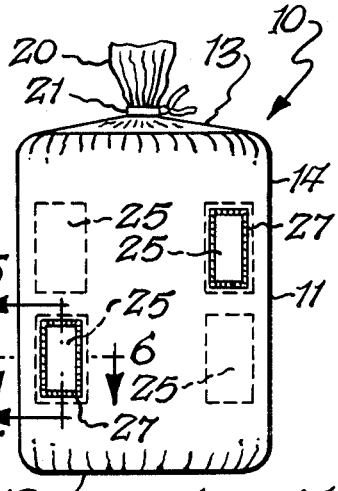
Fig. 4.
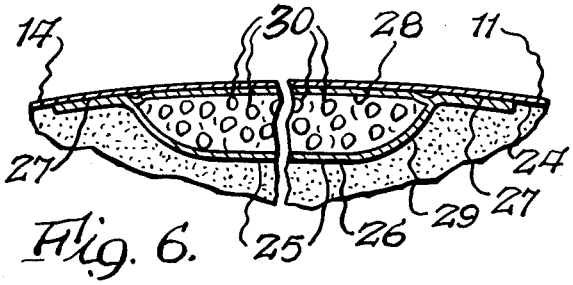
Fig. 6.
Fig. 2.
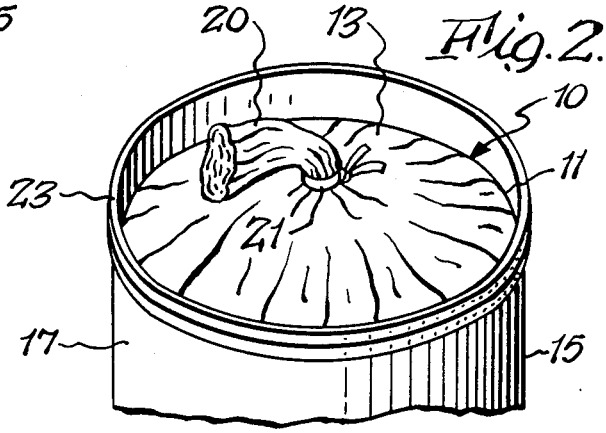

BAG WITH INTEGRAL MATERIAL TREATING PACKETS

BACKGROUND OF THE INVENTION

The present invention relates to a bag with permanently secured packets of conditioning material therein for maintaining the contents of the bag in a predetermined state of preservation.

By way of background, various types of bulk material are shipped in fiberboard drums which contain a plastic bag liner. In the past the bulk material within the bag was maintained in a desired state of preservation by packets of conditioning material which were thrown in at random. However, separating these packets from the bulk material was a nuisance, and further, if the packets were inadvertently dumped with the bulk material for processing, they could contaminate the processed material.

SUMMARY OF THE INVENTION

It is accordingly the object of this invention to provide an improved bag having packets of conditioning material firmly secured to the inside surface thereof for maintaining bulk material within the bag in a desired state of preservation, without the possibility existing of the packets being dumped with the bulk material. Other objects and attendant advantages of the present invention will readily be perceived hereafter.

The present invention relates to a liner insert for a drum type of container or the like which is to contain a first material which is to be preserved in a predetermined condition therein comprising wall means for containing said first material therein, and packet means secured to said wall means, said packet means comprising permeable casing means, and a second material within said permeable casing means for conditioning said first material. The present invention also relates to a bag having integral packets of conditioning material secured to the inner surface thereof and which need not be used as a liner insert.

The various aspects of the present invention will be more fully understood when the following portions of the specification are read in conjunction with the accompanying drawings wherein:

BRIEF DESCRIPTION OF THE DRAWINGS

FIG. 1 is an exploded view of a drum type of container having a liner bag therein and a cover therefor;

FIG. 2 is a fragmentary perspective view of the liner within the drum type of container;

FIG. 3 is a plan view of the liner of FIG. 1 taken substantially in the direction of arrows 3—3;

FIG. 4 is a side elevational view of the liner of FIG. 1;

FIG. 5 is a fragmentary cross sectional view taken substantially along line 5—5 of FIG. 4; and FIG. 6 is a fragmentary cross sectional view taken substantially along line 6—6 of FIG. 4.

DESCRIPTION OF THE PREFERRED EMBODIMENTS

The improved liner 10 of the present invention comprises a bag 11 having a bottom wall 12, a top wall 13, and a side wall 14. Bag 11 is preferably fabricated of polyethylene sheet material and is of the tubular shape shown in the drawings, but it can be fabricated of any other suitable material.

Bag 11 is intended to be inserted into drum-type of fiberboard container 15 having a cylindrical side wall 17 and a bottom 19, but it can be used with any other suitable container. After bag 11 has been inserted, the open mouth of bag 11 receives bulk material which may be in powder or granular form or in any other form. This material may be precious metals or powdered plastic or any other type of material which must be maintained in a conditioned environment so that it may be preserved in a given state prior to use. Accordingly, after bag 11 has been filled, the top wall 13 is gathered at 20, as shown, and a suitable tie member 21 closes and effectively seals the top of the bag. Thereafter, the cover 22 is mounted on rim 23 of the container.

In the past, packets of conditioning material containing a desiccant, adsorbent, or absorbent, or combinations of the foregoing, were thrown into a bag, such as 11, in a random manner to maintain the bulk material therein in a predetermined state of preservation. However, when bag 11 was emptied of its bulk material, the loose bags of conditioning material had to be separated therefrom, which was a time-consuming nuisance. In addition, if all of the bags of conditioning material were not removed, they could be dumped with the bulk material and thus constitute a contaminant in subsequent processing operations.

In accordance with the present invention the inner surface 24 of bag 11 has a plurality of packets 25 positively secured thereto. Each packet contains a suitable powdered or granular conditioning material 30, such as a desiccant, adsorbent or absorbent, which may be required to maintain the bulk material within bag 11 in a desired state of preservation. Each packet 25 includes a casing 29 having opposed walls 26 and 28 and an outer border 27 which is a fusion of the walls 26 and 28. Alternatively, walls 26 and 28 can be secured to each other in any other suitable manner including but not limited to sewing, gluing and the like. Border 27, which constitutes the entire perimeter of each packet, is heat-sealed, or otherwise suitably attached to bag wall 14. Thus, each packet 25 is firmly attached to the inside surface of wall 14 and cannot be dispensed therefrom with the bulk material which is contained therein.

In order to permit the conditioning material 30 of each packet 25 to act on the bulk material contained in bag 11, the casing 29 of each packet 25 is permeable to permit communication between the conditioning material in packet 25 and the space containing the bulk material within bag 11. The casing 29 may be fabricated from suitable web-bonded material or a material known as TYVEC or any other suitable permeable fabric or plastic material.

As can be seen from FIG. 3, packets 25 are spaced uniformly about the circumference of bag 11, and as can be seen from FIGS. 1 and 4, the diametrically opposite packets 25 are at different elevations. The foregoing arrangement is for the purpose of causing all of the bulk material in bag 11 to have a greater exposure to packets 25 than if the packets were inserted at random. It will be appreciated that packets 25 may be attached in any desired pattern, and that any desired number of packets may be used, depending on the requirements of any particular bulk material.

While preferred embodiments of the present invention have been disclosed, it will be appreciated that it is not limited thereto but may be otherwise embodied within the scope of the following claims.

What is claimed is:

1. A liner insert which is to be inserted into an outer container and which is to contain a first material which is to be preserved in a predetermined condition comprising wall means for containing said first material therein, packet means secured to said wall means, said packet means comprising permeable casing means, and a second material within said permeable casing means for conditioning said first material, said packet means comprising a plurality of permeable casing means each containing said second material, said plurality of casing means being spaced from each other.

2. A liner insert as set forth in claim 1 wherein said wall means comprises a flexible bag.

3. A liner insert as set forth in claim 1 wherein said plurality of casing means are spaced both vertically and horizontally from each other.

4. A liner insert as set forth in claim 3 wherein said wall means comprises a flexible bag.

5. A liner insert as set forth in claim 1 wherein said plurality of permeable casing means comprise first casing means at a lower level and second casing means at a higher level.

6. A liner insert as set forth in claim 5 wherein said wall means comprises a flexible bag.

7. A liner insert as set forth in claim 5 wherein said first casing means comprise a plurality of casing means spaced from each other, and wherein said second casing means comprise a plurality of casing means spaced from each other.

8. A liner insert as set forth in claim 7 wherein said wall means comprises a flexible bag.

9. A bag for containing a first material which is to be preserved in a predetermined condition comprising wall means for containing said first material therein, packet means secured to said wall means, said packet means comprising permeable casing means, and a second material within said permeable casing means for conditioning said first material, said packet means comprising a plurality of permeable casing means each containing said second material, said plurality of casing means being spaced from each other.

10. A bag as set forth in claim 9 wherein said bag is fabricated of flexible material.

11. A bag as set forth in claim 9 wherein said plurality of casing means are spread both vertically and horizontally from each other.

12. A bag as set forth in claim 11 wherein said bag is fabricated of flexible material.

13. A bag as set forth in claim 9 wherein said plurality of permeable casing means comprise first casing means at a lower level and second casing means at a higher level.

14. A bag as set forth in claim 13 wherein said bag is fabricated of flexible material.

15. A bag as set forth in claim 13 wherein said first casing means comprise a plurality of casing means spaced from each other, and wherein said second casing means comprise a plurality of casing means spaced from each other.

16. A bag as set forth in claim 15 wherein said bag is fabricated of flexible material.

* * * * *